US011846111B2

(12) United States Patent
Tangney et al.

(10) Patent No.: US 11,846,111 B2
(45) Date of Patent: Dec. 19, 2023

(54) SYSTEMS FOR INSTALLING AN ELONGATED STAKE TO A SUPPORT POST TO PROVIDE STURDINESS TO THE SUPPORT POST, AND METHODS OF USE THEREOF

(71) Applicants: Chase Mckean Tangney, Gig Harbor, WA (US); Wayne Hogan, Gig Harbor, WA (US)

(72) Inventors: Chase Mckean Tangney, Gig Harbor, WA (US); Wayne Hogan, Gig Harbor, WA (US)

( * ) Notice: Subject to any disclaimer, the term of this patent is extended or adjusted under 35 U.S.C. 154(b) by 103 days.

(21) Appl. No.: 17/569,420

(22) Filed: Jan. 5, 2022

(65) Prior Publication Data

US 2022/0290460 A1 Sep. 15, 2022

Related U.S. Application Data

(60) Provisional application No. 63/159,904, filed on Mar. 11, 2021.

(51) Int. Cl.
*E04H 12/22* (2006.01)
*E04H 17/22* (2006.01)
(Continued)

(52) U.S. Cl.
CPC ..... *E04H 12/2292* (2013.01); *E04H 12/2253* (2013.01); *E04H 17/22* (2013.01);
(Continued)

(58) Field of Classification Search
CPC . E04H 12/2292; E04H 12/2253; E04H 17/22; E04H 12/347; E04H 12/348; E04H 17/08; E04H 17/26; E04H 12/2215
See application file for complete search history.

(56) References Cited

U.S. PATENT DOCUMENTS 1,402,561 A * 1/1922 Banks ..... E04H 12/2215 52/156
4,120,125 A * 10/1978 Cvetan ..... E01F 9/685 52/156

(Continued)

FOREIGN PATENT DOCUMENTS

GB 2139663 A * 11/1984 ..... E04H 12/2292

*Primary Examiner* — Brian D Mattei
*Assistant Examiner* — Omar F Hijaz
(74) *Attorney, Agent, or Firm* — Morgan, Lewis & Bockius LLP

(57) ABSTRACT

A system for providing sturdiness to a support post, that includes a stake that is configured to be inserted into the ground such that it is positioned parallel to a support post that is perpendicular to the ground and an insertion-assistance member that is configured to be removably attached to the stake. The insertion-assistance member includes a body, and a lip that extends in a direction that is perpendicular to the body such that a portion of the lip extends beyond the body in the direction that is perpendicular to the body. The lip is configured to receive force and then transmit the force to the stake to drive the stake into the ground. After driving the stake into the ground, the insertion-assistance member is configured to be removed from the stake and the stake is then secured to the support post to provide sturdiness to the support post.

18 Claims, 6 Drawing Sheets

(51) Int. Cl.
*E04H 12/34* (2006.01)
*E04H 17/26* (2006.01)
*E04H 17/08* (2006.01)

(52) U.S. Cl.
CPC ..... *E04H 12/347* (2013.01); *E04H 12/348* (2013.01); *E04H 17/08* (2013.01); *E04H 17/26* (2013.01)

(56) References Cited

U.S. PATENT DOCUMENTS

| | | | | | |
|---|---|---|---|---|---|
| 4,483,506 | A * | 11/1984 | Litwiller | E04H 12/2215 | 248/156 |
| 5,050,828 | A * | 9/1991 | Wolff | G09F 7/20 | 248/156 |
| 5,881,495 | A * | 3/1999 | Clark | A01G 25/02 | 52/165 |
| 10,352,064 | B2 * | 7/2019 | Gilmer | E04H 15/62 | |
| 11,084,156 | B1 * | 8/2021 | Jordan | E04H 12/347 | |
| 2005/0211866 | A1 * | 9/2005 | Chambers | E04H 12/2215 | 248/507 |
| 2007/0228349 | A1 * | 10/2007 | Smith | E01F 13/028 | 160/122 |
| 2012/0110862 | A1 * | 5/2012 | Mann | E04H 12/2215 | 30/366 |

* cited by examiner

SYSTEMS FOR INSTALLING AN ELONGATED STAKE TO A SUPPORT POST TO PROVIDE STURDINESS TO THE SUPPORT POST, AND METHODS OF USE THEREOF

This application claims priority to U.S. Provisional Application Ser. No. 63/159,904, filed on Mar. 11, 2021, entitled "Systems for Installing an Elongated Stake to A Support Post to Provide Sturdiness to The Support Post, And Methods of Use Thereof," which is incorporated by reference herein in its entirety.

TECHNICAL FIELD

The present disclosure relates generally to systems and devices for inserting elongated stakes into the ground with the aid of an insertion-assistance member, then securing standing support posts (e.g., posts such as fence posts, mailboxes, poles, or any other vertical standing structure) to the elongated stake, and methods of use thereof, which then provides structural support to the standing support posts through a this straightforward and low-labor installation process.

BACKGROUND

Traditionally, installation of support posts is a laborious process that requires digging holes to insert support poles or posts into the ground, pouring concrete, and burying the support poles or posts into the ground. For repetitive processes, such as securing multiple support posts to set up a residential fence or encasing industrial properties with fences, these steps can waste valuable time and effort. In cases where support posts are failing (e.g., rotting or rusting depending on material type) an installer is left with the choice of leaving the support post in a damaged condition or pulling the post out and replacing it, which, again, can be time-consuming by requiring removal steps in addition to repeating the same laborious process discussed above. In some instances, support posts may also sag over time for various reasons (e.g., the ground shifting over time) and even after correction may continue to sag again repeatedly, which requires the installer to have to constantly correct the support post, all of which takes valuable time and effort.

As such, it would be desirable to provide systems, devices, and methods that address the above-mentioned drawbacks by providing sturdiness to a support post without the numerous steps and upkeep that is traditionally required for installing and maintaining structurally-stable support posts.

SUMMARY

Accordingly, there is a need for post-support systems that address the problems identified above. To this end, systems and methods described herein are capable of allowing easy and efficient installation and repair/maintenance of support posts, without numerous process steps. This greatly reduces both the installation time, removal time, and/or repair time for each support post. The inventive post-support system described herein also makes use of a reusable insertion-assistance member (e.g., insertion-assistance member 100 (FIGS. 1A and 1B)), which can be easily slid on top of an elongated stake (stake 200, FIGS. 2A-2B) to aid in inserting the stake into the ground before securing the stake to a support post (e.g., support post 300, FIG. 3C). This helps to further speed up installation by giving the installer an easy location at which force can be applied to the elongated stake. It also allows the user to correct sagging fences faster by allowing the installer to insert a new elongated stake without having to dig up the support post and relocate it. Moreover, using a reusable insertion-assistance member further reduces the amount of material to be used for the elongated stake, which has the benefit of lowering end-user costs and reducing manufacturing complexity for the post-support system as a whole.

(A1) In accordance with some embodiments, a system for providing sturdiness to a support post is provided. The system includes an elongated stake (e.g., a stake 200 that is taller than it is wide, such as that shown in FIGS. 2A-2B) having a pointed end (e.g., pointed end 210, FIGS. 2A-2B) that is configured to be inserted into the ground such that it is positioned parallel (or, at least, substantially parallel, such as within +/−5% of parallel) to a support post that is substantially perpendicular (e.g., within +−5% of perpendicular to the ground, so between 85-95 degrees relative to a horizontal plane from the ground) to the ground. Examples of support posts include, but are not limited to, fence posts in a residential property (e.g., as shown in FIG. 4), fence posts surrounding farmland or pastures (e.g., as shown in FIG. 4), and can also include mailbox posts (e.g., as shown in FIG. 5), etc. The system also includes an insertion-assistance member (e.g., a hollow-bodied structure that includes a solid lip to allow for assistance with driving the elongated stake into the ground, such as the insertion-assistance member 100 shown in FIGS. 1A and 1B) that is configured to be removably attached to the elongated stake, the insertion-assistance member including (e.g., as shown in FIGS. 2A-2B where the insertion-assistance member is removably attached to the elongated stake 100). The insertion-assistance member includes a body, and (e.g., a hollow body, such as body component 104 shown in FIG. 1B that includes a hollow portion 108, that is configured to fit over the top of the elongated stake (e.g., as shown in FIGS. 2A-2B)) a lip (e.g., made of a solid material that is able to receive force from various types of hammers, such as lip component 102 shown in FIGS. 1A-1B) that extends in a direction that is substantially perpendicular (e.g., within +/−5% of perpendicular) to the body such that a portion of the lip extends beyond the body in the direction that is substantially perpendicular to the body. In some embodiments, the lip is configured to receive force and then transmit the force to the elongated stake to drive the elongated stake into the ground (e.g., as shown in FIGS. 3A-3B, which show the insertion-assistance member 100 coupled to the elongated stake 200 and the elongated stake being driven into the ground 302). In some embodiments, the solid lip of the insertion-assistance member is a protrusion (e.g., flange) that aids in inserting the elongated stake into the ground, by providing a surface that allows force to be applied to insert the elongated stake into the surface. In some embodiments, the lip (e.g., protrusion, flange, etc.) is substantially circular in shape (e.g., to match the force applied by the surface of a hammer). In some embodiments, after driving the elongated stake into the ground via the force received by the lip (e.g., as shown in FIG. 3B), the insertion-assistance member is configured to be removed from the elongated stake and the elongated stake is configured to then be secured to the support post (e.g., as shown in FIG. 3C the elongated stake 200 is secured to support post 300) to provide sturdiness (for purposes of this application the term sturdiness means the ability to withstand force or stress without being distorted, dislodged, or damaged) to the support post. In embodiments in which the system is used to restore sturdiness to a failing support post, the system can be said to also restore structural integrity to the failing support post, in addition to also providing sturdiness to that failing support post (e.g., FIGS. 4 and 5 illustrate the elongated stake 200 providing sturdiness to failing support post 400 and failing mailbox post 500).

(A2) In some embodiments of (A1), the elongated stake has a first shape, and the insertion-assistance member is reusable (e.g., with many different elongated stakes) and is configured and sized to also be removably attached to another elongated stake having a second shape that is distinct from the first shape. For example, the first shape has a substantially rectangular outline, such as that shown for the first elongated stake 200 in FIGS. 2A-2B; while the second shape can have a substantially circular profile for the second elongated stake. In other words, the insertion-assistance member is configured to attach to elongated stakes of varying designs (e.g., the insertion-assistance member can be connected to elongated stakes of different sizes and/or shapes (e.g., a different shape such as having the sides of the elongated stake be serrated to better resist movement)).

(A3) In some embodiments of (A1)-(A2), the body of the insertion-assistance member has a hollow interior (e.g., as shown by hollow portion 108 in FIGS. 1A-1B), and the insertion-assistance member is configured to be removably attached to the elongated stake by placing it on top of the elongated stake at an end of the elongated stake that is opposite to the pointed end (e.g., as illustrated in FIGS. 2A-2B which depict the insertion-assistance member 100 placed on top of the elongated stake 200).

(A4) In some embodiments of (A1)-(A3), the lip of the insertion-assistance member is made of a solid material, and the body of the insertion-assistance member has a hollow interior (e.g., as shown in FIGS. 1A-1B).

(A5) In some embodiments of (A1)-(A4), the elongated stake (e.g., elongated stake 200 in FIGS. 2A-2B) includes at least one hole passing therethrough, and the elongated stake is configured to be secured to the support post by inserting a fastener (e.g., fasteners 202A and 202B shown in FIGS. 2A-2B, 3C-3D, 4 and 5) through the hole and into a portion of the support post.

(A6) In some embodiments of (A1)-(A5), the elongated stake includes two holes passing therethrough, and the elongated stake is configured to be secured to the support post by inserting a respective fastener through each respective hole of the two holes into a respective portion of the support post (e.g., as shown in FIGS. 3C, 4, and 5 where fasteners 202A and 202B can be used to secure the elongated stake 200 to any of the support post 300, failing support post 400, and failing mailbox post 500).

(A7) In some embodiments of (A1)-(A6), at least one of the fasteners is selected from a group consisting of a slidable pin, a nail, a screw, or a rivet.

(A8) In some embodiments of (A1)-(A7), the fastener is removable (e.g., FIGS. 3C-3D illustrate that fasteners 202A and 202B are removable).

(A9) In some embodiments of (A1)-(A8), the insertion-assistance member is configured to, after removably attaching to the elongated stake for a second time, enable removal of the elongated stake from the ground by application of a removal force to the lip of the insertion-assistance member. For example, FIG. 3D shows that the insertion-assistance member 100 is secured to the elongated stake 200 to remove the elongated stake 200 from the ground 302.

(A10) In some embodiments of (A9), the insertion-assistance member has at least one hole passing therethrough (e.g., holes 106A and 106B shown in FIGS. 1A-1B), and the removably attaching of the insertion-assistance member to the elongated stake for the second time is by way of a fastener that is placed through the at least one hole of the insertion-assistance member and through at least one hole of the elongated stake. For example, FIG. 3D shows that the insertion-assistance member 100 is secured to the elongated stake 200 by the way of fasteners 202A or 202B to remove the elongated stake 200 from the ground 302).

(A11) In some embodiments of any of (A9)-(A10), the insertion-assistance member has at least two holes passing therethrough (e.g., holes 106A and 106B shown in FIGS. 1A-1B), and the removably attaching of the insertion-assistance member to the elongated stake for the second time is by way of two fasteners that are placed through the at least two holes of the insertion-assistance member and through at least two holes of the elongated stake. For example, FIG. 3D shows that the insertion-assistance member 100 is secured to the elongated stake 200 by the way of fasteners 202A and 202B to remove the elongated stake 200 from the ground 302.

(A12) In some embodiments of (A9)-(A11), the elongated stake is secured to the support post to provide sturdiness by way of the fastener (e.g., as illustrated by the elongated member securing to the support post 300, the failing support post 400, and failing mailbox post 500 in FIGS. 3C, 4 and 5, respectively). In some embodiments, the fastener is configured to be removed from the elongated stake and the support post for use with the removably attaching of the insertion-assistance member to the elongated stake for the second time. In some embodiments, the elongated stake is secured to the support post to provide sturdiness by way of two fasteners, the two fasteners are configured to be removed from the elongated stake and the support post for use with the removably attaching of the insertion-assistance member to the elongated stake for the second time. In some embodiments, removing (e.g., detaching) the support post from the elongated stake is done so by unscrewing the support post from the elongated stake. After unscrewing the fasteners, the insertion-assistance member can be reattached to the same or a different elongated stake (e.g., in the same manner in which the insertion-assistance member was first attached to the elongated stake (e.g., screwed on, bolted on, etc.)). In some embodiments, the insertion-assistance member is configured to receive force (e.g., an upward force) to remove the elongated stake from the ground.

(A13) In some embodiments of (A1)-(A12), a shape of the support post is cylindrical, rectangular, triangular, or polygonal (e.g., support posts shown in FIGS. 3C, 4, and 5 include at least some examples of support posts that an elongated stake 200 can be coupled to).

(A14) In some embodiments of (A1)-(A13), a shape of the elongated stake corresponds to the shape of the support post (e.g., elongated stake can have a flat surface to be mated to a flat support post (e.g., FIGS. 4 and 5 illustrate the elongated stake 200 affixed to a flat support post), or elongated stake can have a curved surface to be mated to a curved support post (e.g., support post 300 shown in FIG. 3C, which can cylindrically shaped in some embodiments).

(A15) In some embodiments of (A1)-(A14), a length of the insertion-assistance-member is 5% to 25% of a length of the elongated stake (e.g., in FIG. 2B the ratio between the length 214 of insertion-assistance member 100 relative to the length 216 of the elongated stake 200 is indicated).

(A16) In some embodiments of (A1)-(A15), a width of the insertion-assistance-member is 110% to 125% of a width of the elongated stake (e.g., in FIG. 2B the ratio between the width 218 of the insertion-assistance member 100 relative to the width 220 of the elongated stake 200 is indicated).

(A17) In some embodiments of (A1)-(A16), the support post is not secured to the ground using a composite material (e.g., concrete) and is instead only secured to the ground by way of the elongated stake.

(A18) In some embodiments of (A1)-(A17), a material of the elongated stake is the same as a material of the insertion-assistance member (e.g., both are made of a metal or alloy material).

(A19) In some embodiments of (A1)-(A18), the insertion-assistance member is made from one or more of wood, steel, aluminum, alloy, plastic, or composite.

(A20) In some embodiments of (A1)-(A19), the support post is a rotted or failing support post (e.g., as illustrated by failing support post 400 and failing mailbox post 500). In some embodiments, the rotted support post lacks structural integrity and requires additional support to remain upright, which is thereafter provided by the elongated stake using the inventive post-support system described herein.

(B1) In accordance with some embodiments, a method is also provided for using the inventive post-support system described herein to provide sturdiness to a support post. The method includes positioning an elongated stake (e.g., a stake 200 that is taller than it is wide, such as that shown in FIGS. 2A-2B) having a pointed end that is configured to be inserted into the ground such that it is positioned parallel to the support post that is substantially perpendicular to the ground. The method also includes removably attaching an insertion-assistance member to the elongated stake. The insertion-assistance member can include: a body, and a lip that extends in a direction that is substantially perpendicular to the body such that a portion of the lip extends beyond the body in the direction that is substantially perpendicular to the body, and the lip is configured to receive force and then transmit the force to the elongated stake to drive it into the ground. In some embodiments, the lip (e.g., protrusion, flange, etc.) is substantially circular in shape (e.g., to match the force applied by the surface of a hammer). The method further includes driving the elongated stake into the ground via force applied to the lip of the insertion-assistance member, and then removing the insertion-assistance member from its attachment to the elongated stake. The method then includes securing the elongated stake to the support post to provide sturdiness to the support post. In embodiments in which the system is used to restore sturdiness to a failing support post, the system can be said to also restore structural integrity to the failing support post, in addition to also providing sturdiness to that failing support post (e.g., FIGS. 4 and 5 illustrate the elongated stake 200 providing sturdiness to failing support post 400 and failing mailbox post 500).

(B2) In accordance with some embodiments, the method of B1 is performed such that the elongated stake, the insertion-assistance member, and/or the support post have any of the aspects recited in any of A1-A20 discussed above.

(C1) In accordance with some embodiments, an insertion-assistance member used in a system for providing sturdiness to a support post, comprises a body that is configured to be removably attached to a support post, and a lip that extends in a direction that is substantially to the body such that a portion of the lip extends beyond the body in the direction that is substantially perpendicular to the body (In some embodiments, the lip is configured to receive force and then transmit the force to the elongated stake to drive the elongated stake into the ground. In some embodiments, the solid lip of the insertion-assistance member is a protrusion (e.g., flange) that aids in inserting the elongated stake into the ground, by providing a surface that allows force to be applied to insert the elongated stake into the surface. In some embodiments, the lip (e.g., protrusion, flange, etc.) is substantially circular in shape (e.g., to match the force applied by the surface of a hammer). In some embodiments, the elongated stake (e.g., a stake 200 that is taller than it is wide, such as that shown in FIGS. 2A-2B) has a pointed end that is configured to be inserted into the ground such that it is positioned parallel to the support post that is substantially perpendicular to the ground. In some embodiments, after driving the elongated stake into the ground via the force received by the lip, the insertion-assistance member is configured to be removed from the elongated stake and the elongated stake is configured to then be secured to the support post to provide sturdiness to the support post. In embodiments in which the system is used to restore sturdiness to a failing support post, the system can be said to also restore structural integrity to the failing support post, in addition to also providing sturdiness to that failing support post (e.g., FIGS. 4 and 5 illustrate the elongated stake 200 providing sturdiness to failing support post 400 and failing mailbox post 500).

Note that the various embodiments described above can be combined with any other embodiments described herein. The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

So that the present disclosure can be understood in greater detail, a more particular description may be had by reference to the features of various embodiments, some of which are illustrated in the appended drawings. The appended drawings, however, merely illustrate pertinent features of the present disclosure and are therefore not to be considered exhaustive illustrations of every possible embodiment, for the description may admit to other effective features consistent with the inventive aspects described herein as the person of skill in this art will appreciate upon reading this disclosure.

Figure 1B:
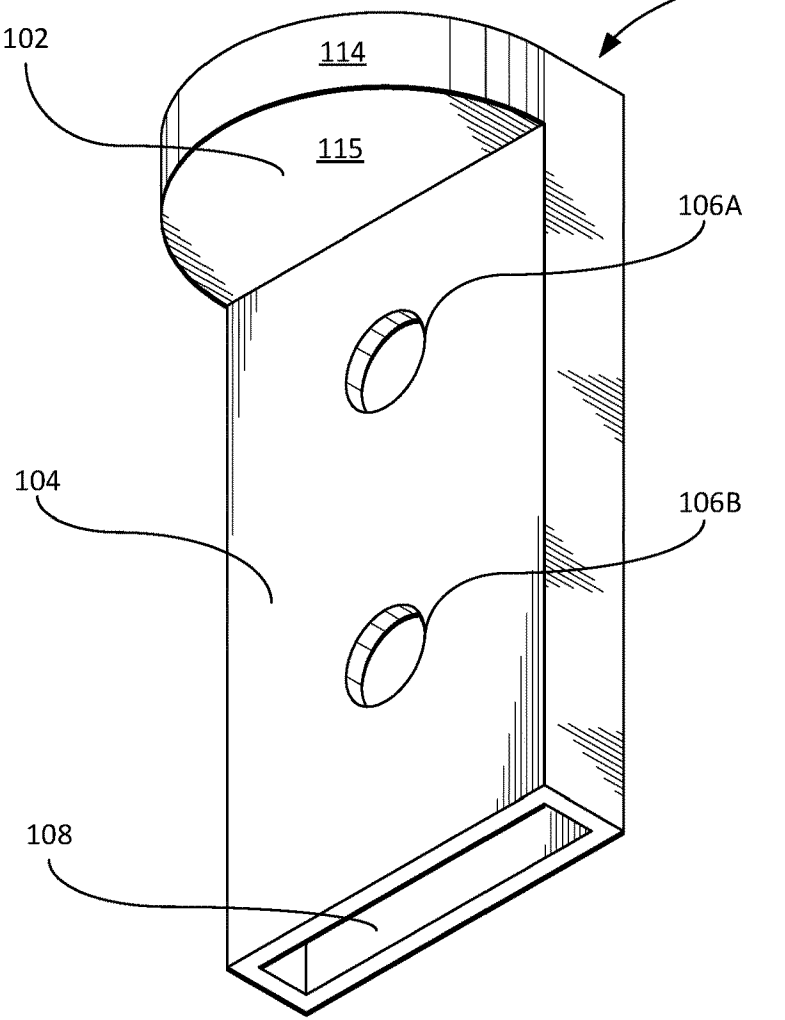
FIGS. 1A-1B illustrate different views of an insertion-assistance member that is configured to be coupled to an elongated stake to aid in insertion into the ground and removal from the ground of the elongated stake, in accordance with some embodiments.

In accordance with common practice, the various features illustrated in the drawings may not be drawn to scale. Accordingly, the dimensions of the various features may be arbitrarily expanded or reduced for clarity. In addition, some of the drawings may not depict all of the components of a given system, method or device. Finally, like reference numerals may be used to denote like features throughout the specification and figures.

DETAILED DESCRIPTION

Numerous details are described herein in order to provide a thorough understanding of the non-limiting example embodiments illustrated in the accompanying drawings. However, some embodiments may be practiced without many of the specific details, and the scope of the claims is only limited by those features and aspects specifically recited in the claims. Furthermore, well-known processes, components, and materials have not been described in exhaustive detail so as not to unnecessarily obscure pertinent aspects of the embodiments described herein.

Figure 1A:
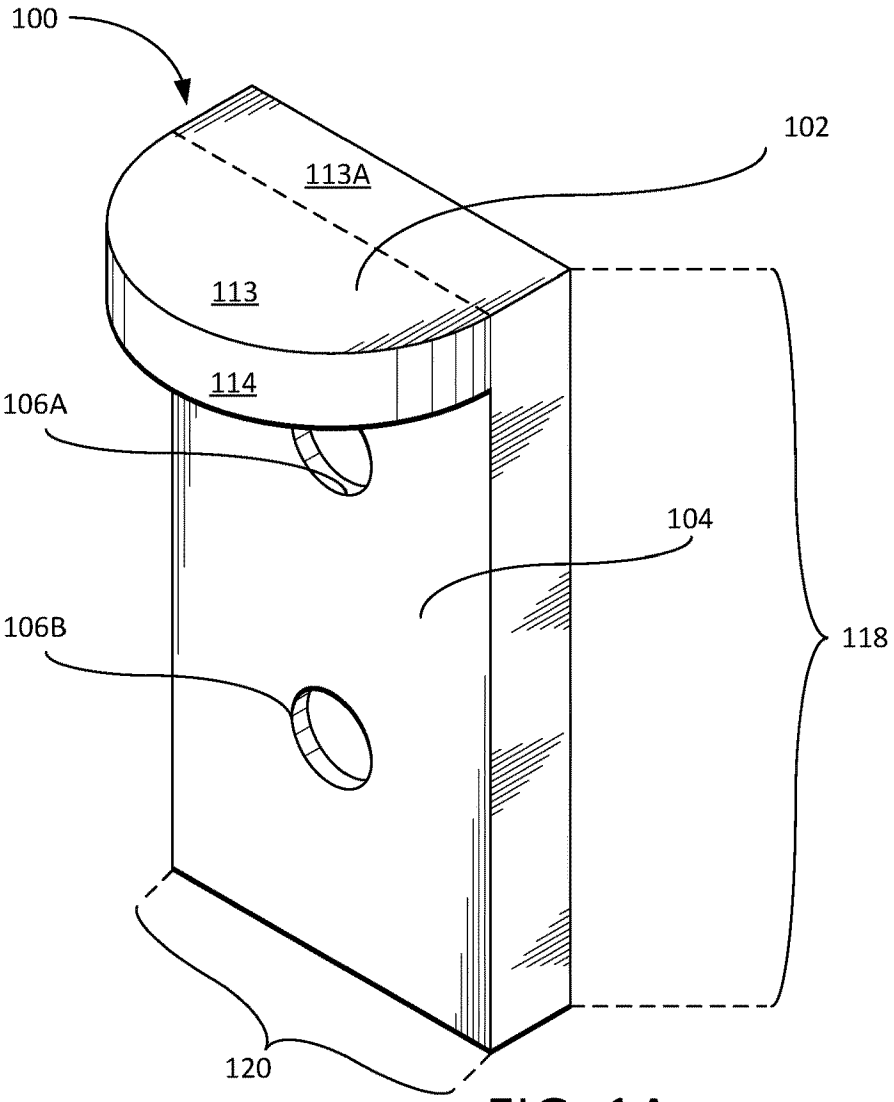

FIGS. 1A-1B illustrate different views of an insertion-assistance member that is configured to be coupled to an elongated stake to aid in insertion into the ground and removal from the ground of the elongated stake, in accordance with some embodiments. The insertion-assistance member 100 of FIGS. 1A and 1B show the component features of the insertion-assistance member 100, including a lip component 102, a body component 104, and holes 106A and 106B that both extend through respective portions of the body component 104. The body component 104 is integrally formed with the lip component 102 in the example embodiment of FIGS. 1A-1B. In other embodiments, the lip component 102 need not be integrally formed with the lip component 102, but could instead be removably attached to the body component 104, e.g., by use of magnets have a strong magnetic attractive force or by use of another form of an adhesive. In the other embodiments, the lip component 102 need not include the additional top portion 113A, which additional top portion 113A would then be considered part of the body component 104.

The insertion-assistance member 100 can be resized, shaped, and formed differently to accommodate different amounts of force, so as to not permanently deform upon receiving insertion force or removal force. The insertion-assistance member is configured to use the least amount of material while still not yielding or substantially yielding (e.g., less than 5% deformation to the structure of the insertion-assistance member when it receives insertion or removal forces) upon receiving force to aid in inserting the elongated stake into the ground and removing the elongated stake from the ground. Due the varying sizes for elongated stakes used for different support posts, the insertion-assistance member can be sized to accommodate different sized elongated stakes while still ensuring the insertion-assistance member will not yield and a minimal amount of material is used to help achieve a low manufacturing cost. Accordingly, in some embodiments, a length of the insertion-assistance member is a certain percentage of the length of the elongated stake (a width of the insertion-assistance member is larger than a width of the elongated stake to ensure that the insertion-assistance member can be removably attached over a top of the elongated stake, so in some embodiments the width of the insertion-assistance member can be 110-125% of the width of the elongated stake). In some embodiments, a length of the insertion-assistance member is between 5-50% of a length of the elongated stake. In some embodiments, for elongated stakes having a larger length, the length of the insertion-assistance member can be closer to the upper bound of this range, while for elongated stakes having a shorter length, the length of the insertion-assistance member can be closer to the lower bound of this range. While 5-50% is given as one illustrative example, other narrower ranges can also be used, such as 5-45%, 5-35%, 5-25%, or even 25-35%, depending on the need to lower manufacturing costs without sacrificing the ability of the insertion-assistance member to perform its job in assisting with insertion of the elongated stake into the ground.

Lip component 102 (which can include a top portion 113, a side portion 114, and a bottom portion 115, FIGS. 1A-1B) is configured to receive an insertion force that is applied at the top portion 113 or a removal force that is applied at the bottom portion 115. The insertion force applied at the top portion 113 is then transmitted to an elongated stake (e.g., elongated stake 200 of FIGS. 2A-2B) to drive the elongated stake into the ground (e.g., as illustrated in FIGS. 3A-3B). A first removal force can be applied to the bottom portion 115 and then be transmitted to the elongated stake to remove the elongated stake from the ground (e.g., as illustrated in FIGS. 3C-3D) or a second removal force (which is a smaller force value than the first removal force) can also be applied to remove the insertion-assistance member from its removable attachment to the elongated stake. In some embodiments, lip component 102 includes a substantially semi-circular flat face (in other words, a cross-section of the lip component 102 taken through the side portion 114 in a plane parallel to the top portion 113 would produce a semi-circular profile; in embodiments in which the lip component 102 is integrally formed with the body component 104, then the profile would become semi-oval-shaped for the illustrated example of FIGS. 1A and 1B). The insertion force and the first removal force can be applied, e.g., using a hammer device, while the second (smaller) removal force can be easily applied by hand alone and without the aid of a mechanical tool. In some embodiments, the lip component 102 can be resized, shaped, and formed differently to accommodate different types of force applying devices (e.g., a jackhammer that applies a downward force, a nail puller found on the back of a hammer, a jack device, other force applying pneumatic tools, etc.).

The body component 104 of the insertion-assistance member is configured to be coupled to an elongated stake (shown in FIGS. 2A-2B) to transmit either insertion or removal force to the elongated stake. In some embodiments, the insertion-assistance member includes at least one hole (e.g., one of hole 106A or 106B in FIGS. 1A and 1B) that allows for a connecting device (e.g., a screw, a pin, a rivet, etc., referred to herein as fasteners) to pass therethrough to affix the insertion-assistance member to an elongated stake (shown in FIGS. 2A-2B). In some embodiments, at least one hole (e.g., hole 106A or 106B) is a threaded hole to allow a screw to be screwed therein.

FIG. 1B further illustrates that the body component 104 includes a hollow portion 108 that allows a non-pointed edge of an elongated stake (shown in FIG. 2A-2B) to be placed within the hollow portion. In some embodiments, the hollow portion has a cross-sectional shape that allows it to fit on top of various stakes of varying shapes and sizes (e.g., rounded stakes, square stakes, rectangular stakes, other polygonal based shapes, etc.). In some embodiments, the hollow portion 108 extends up to the horizontal plane through which bottom portion 115 of the lip component 102 extends and no further. Solid material can then be included above the hollow portion 108 in certain embodiments.

In some embodiments, the insertion-assistance member 100 is made of metal, composite, plastic, wood, or any other material capable of withstanding insertion or removal forces. In some embodiments, the insertion-assistance member is made of the same material as the elongated stake (e.g., elongated stake 200 in FIGS. 2A-2B). In some embodiments, the lip component 102 is made of a material having a higher ultimate tensile strength (UTS) than a material of which the body component 104 is made. For instance, the lip component 102 can be made of a first steel having a first ultimate tensile strength value, while the body component can be made of a second steel having a second ultimate tensile strength value that is lower than the first ultimate tensile strength value (in certain circumstances the second ultimate tensile strength value need only be half of the first ultimate tensile strength value, which can help lead to reduced manufacturing costs as a cheaper material can be used for the body component 104 and a more expensive material can be used for the lip component 102).

Figure 2B:
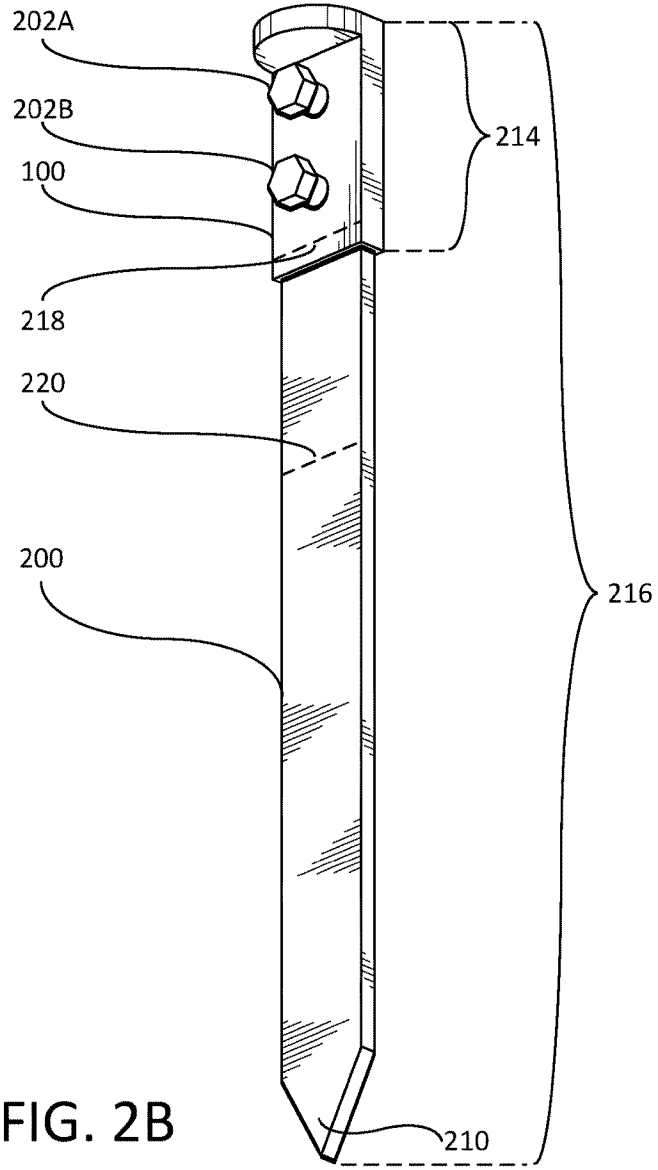
FIGS. 2A-2B illustrate different views of an insertion-assistance member coupled to an elongated stake via fasteners (which can be removable fasteners), in accordance with some embodiments.
Figure 2A:
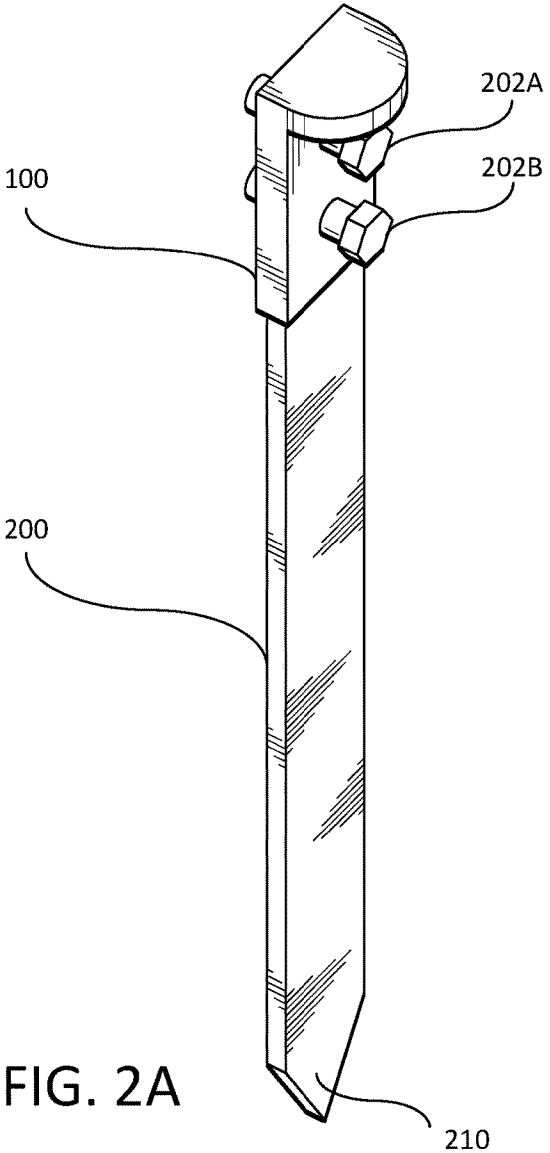
Figures 3A, 3B, 3C, 3D:
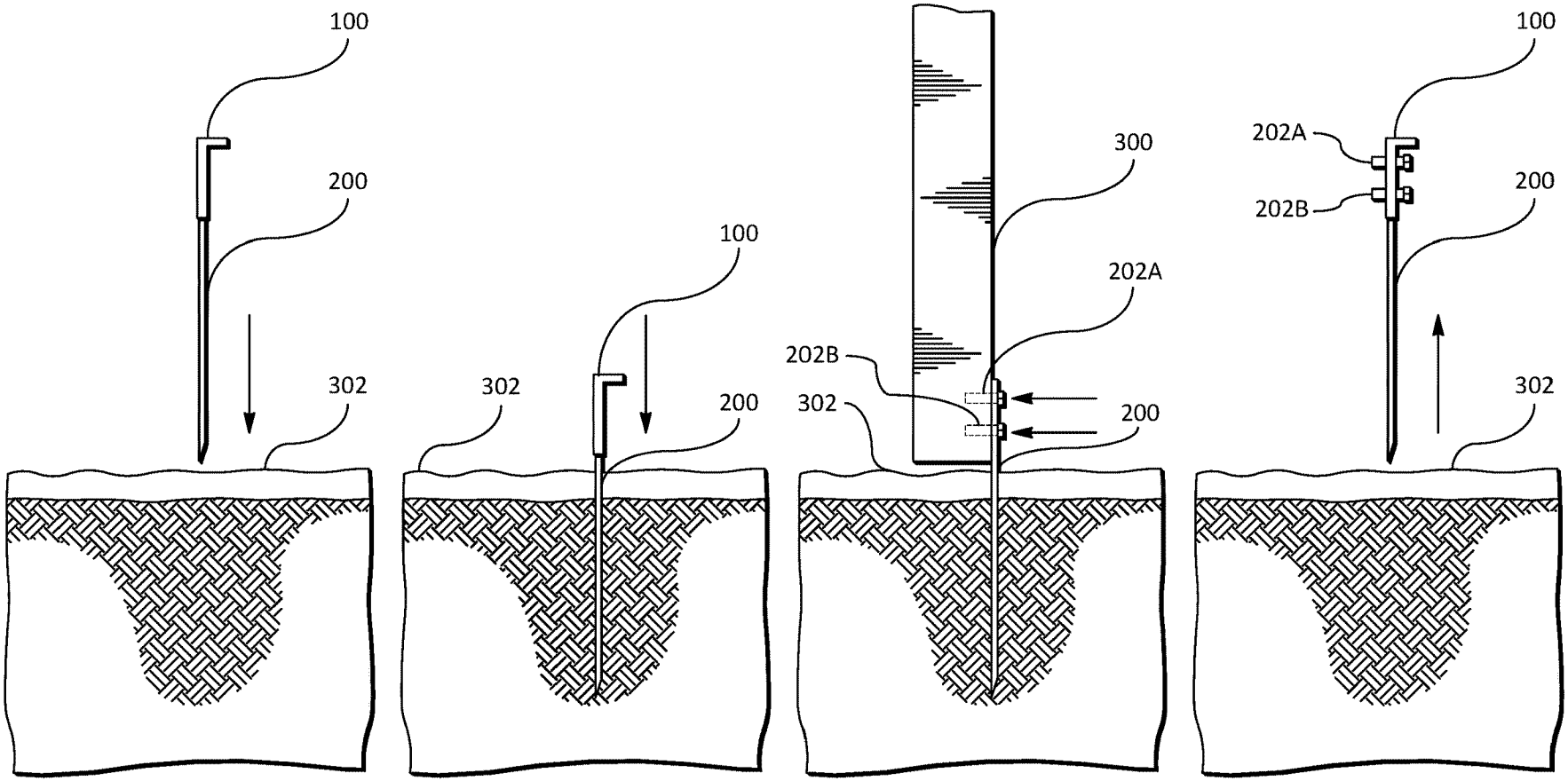
FIGS. 3A-3D illustrate a sequence showing how the elongated stake is inserted into the ground via the aid of an insertion-assistance member (FIGS. 3A-3B), attached to a support post (FIG. 3C), and removed from the ground via the aid of an insertion-assistance member (FIG. 3D), in accordance with some embodiments.

FIGS. 2A-2B show two separate views of an elongated stake 200 removably attached to the insertion-assistance member 100, in accordance with some embodiments. FIGS. 2A-2B also illustrate that two fasteners, 202A and 202B, can be used to keep the insertion-assistance member 100 and the elongated stake 200 coupled together while forces are applied to the insertion-assistance member (e.g., the removal and insertion forces discussed above). For example, this coupling is beneficial when an upward force is applied to the lip component 102 to pull the elongated stake 200 out of the ground. In some embodiments, the elongated stake 200 includes a pointed edge 204 to aid in insertion into the ground. In some embodiments, the elongated state 200 can include serrated edges at least along the pointed end 210 to help keep the elongated stake inserted in the ground.

FIGS. 3A-3D illustrate a sequence that portrays how the insertion-assistance member 100 aids in insertion and removal of an elongated stake 200 in and out of the ground 302. This sequence also portrays how a support post 300 is coupled to the elongated stake after it is inserted into the ground 302.

In particular, FIG. 3A shows that the elongated stake 200 is removably attached to insertion-assistance member 100 by inserting a top portion of the elongated stake 200 into the hollow part (e.g., hollow part 108, FIG. 1B) of the insertion-assistance member 100. In some embodiments, no fasteners are needed to couple the insertion-assistance member 100 to the elongated stake 200 when inserting the elongated stake into the ground 302, as the example of FIGS. 3A-3B visually depicts.

FIG. 3B illustrates the stake 200 being driven into the ground 302 via a downward force received at a lip component 102 of the insertion-assistance member 100.

FIG. 3C illustrates that elongated stake being attached to a support post 300 after the stake 200 has been driven into the ground using the aid of the insertion-assistance member 100. FIG. 3C also illustrates that the insertion-assistance member 100 has been removed from its attachment to the elongated stake 200 before the support post 300 is attached to the elongated stake 200. This allows the insertion-assistance member to be reused for applying insertion and removal force with other elongated stakes. FIG. 3C also shows that the support post 300 is placed on top of the ground but is not inserted into the ground, which aids in ensuring easy installation as an installer need not drive the support post into the ground through laborious post-hole-digging processes.

In other embodiments, the elongated stake 200 can also be attached to support posts that are inserted into the ground.

FIG. 3D illustrates that the insertion-assistance member 100 can be reattached to the elongated stake 200 and then used to pull the elongated stake 200 (e.g., using a removal force) out of the ground 302. The insertion-assistance member 100 is both slotted over the elongated stake 200 and fastened to the elongated stake via fasteners 202A and 202B. The fasteners 202A and 202B allow insertion-assistance member 100 to remain attached to the elongated stake 200 when an upward/removal force is applied to the lip component 102 of the insertion-assistance member 100.

Figure 4:
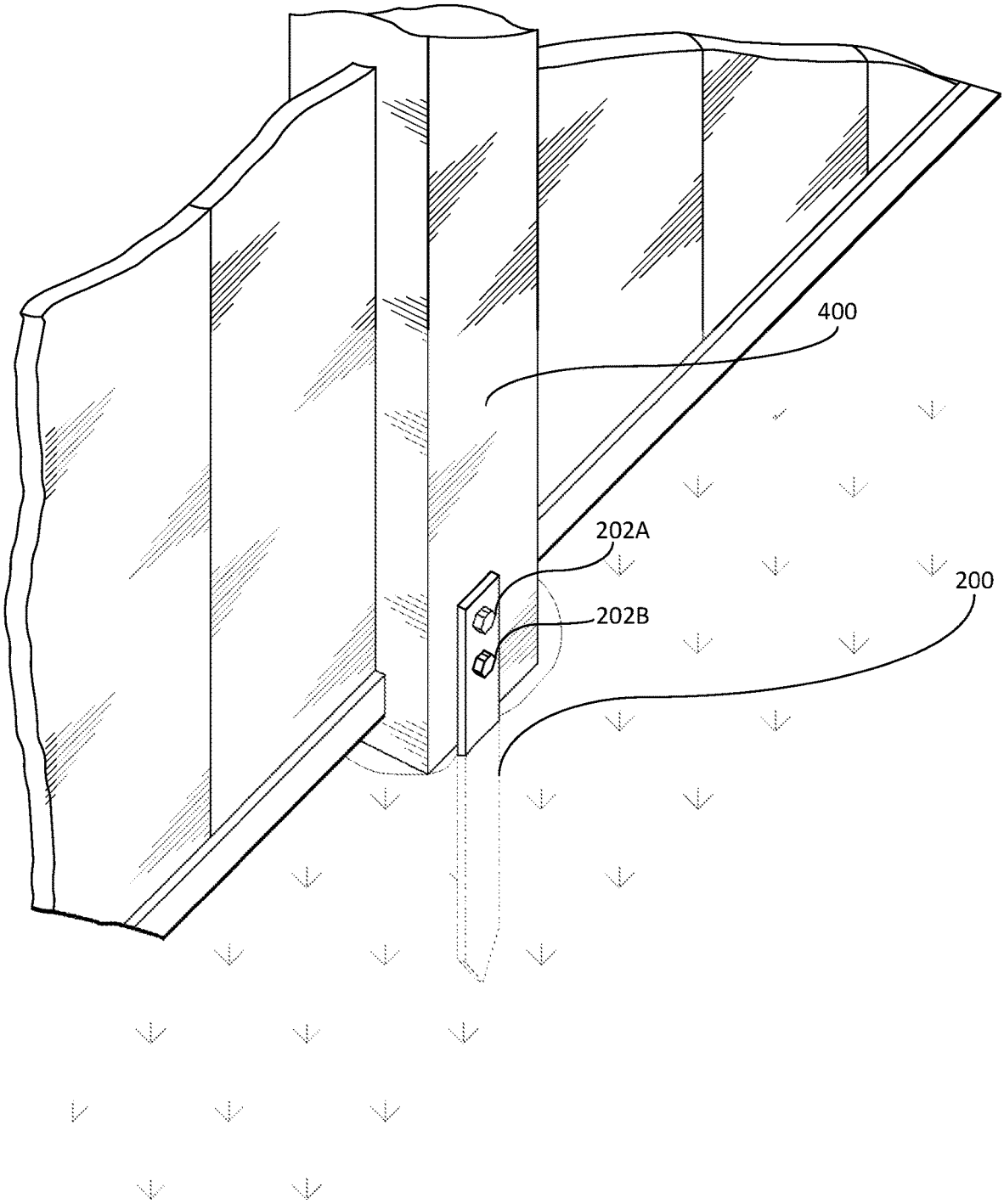
FIG. 4 illustrates that an elongated stake can be coupled to a support post (which can be a failing support post) for a fence to provide sturdiness to the support post 400, in accordance with some embodiments.

FIG. 4 illustrates that the insertion-assistance member 100 (not pictured in FIG. 4) can be used to drive an elongated stake 200 into the ground, and then the elongated stake can be coupled to a failing support post 400 to increase the structural integrity of the failing support post 400. FIG. 4 also illustrates that the elongated stake 200 is attached, via fasteners 202A and 202B, to the failing support post 400 (e.g., a support post for a fence as shown in FIG. 4). In some embodiments, a failing support post 400 is a support post that no longer has the structural integrity to keep itself upright under expected loads (e.g., a fence falling over because the wood of the fence post is starting to rot/deteriorate, or a metal post that has oxidized/rusted to a point where structural integrity has been degraded).

Figure 5:
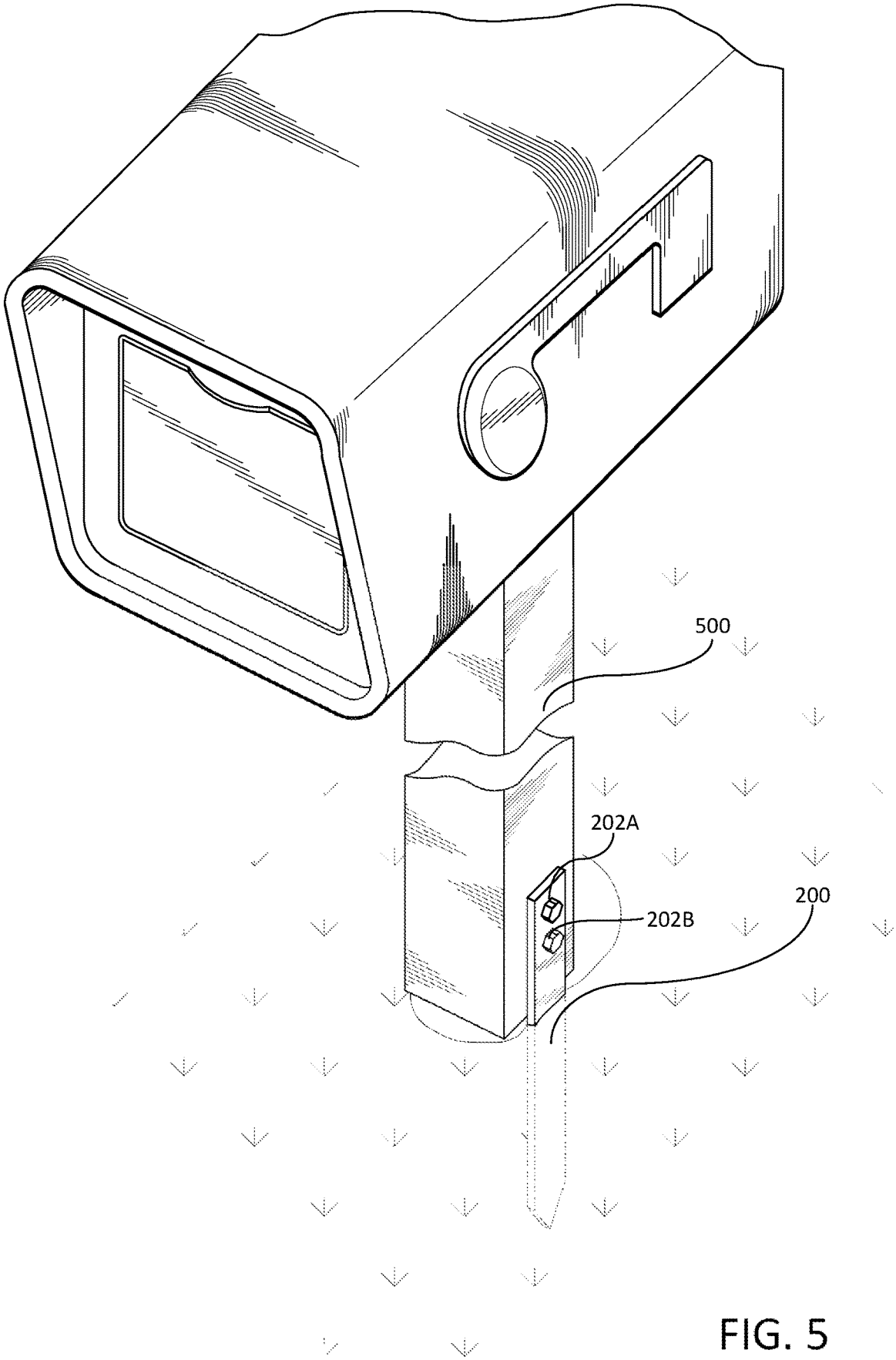
FIG. 5 illustrates that an elongated stake can be coupled to a mailbox post (which can be a failing mailbox post) to provide sturdiness to the failing mailbox post, in accordance with some embodiments

FIG. 5 illustrates another use can for the post-support system described herein, in which the insertion-assistance member 100 (not pictured in FIG. 5) has been used to drive an elongated stake into the ground, and then the elongated stake can be coupled to a failing mailbox post 500 to increase the structural integrity of the failing mailbox post 500. FIG. 5 also illustrates that the elongated stake 200 is attached, via fasteners 202A and 202B, to the failing mailbox post 500.

Figure 6:
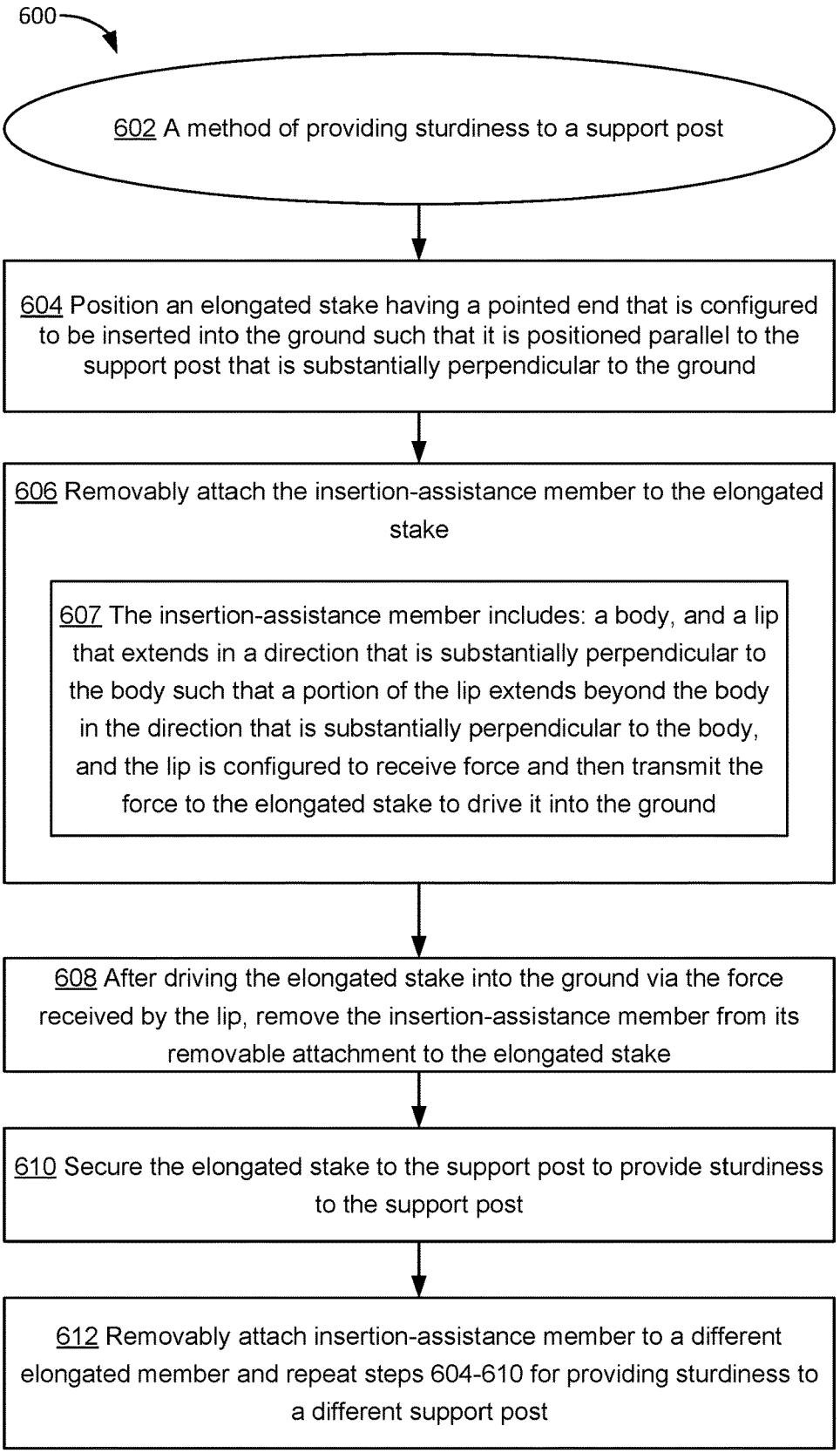
FIG. 6 is a flow diagrams showing a method of providing sturdiness to a support post, in accordance with some embodiments.

FIG. 6 is a flow diagram showing a method of providing sturdiness to a support post, in accordance with some embodiments (602). In some embodiments, elongated stake (e.g., a stake 200 that is taller than it is wide, such as that shown in FIGS. 2A-2B) is positioned (604) to have a pointed end that is configured to be inserted into the ground such that it is positioned parallel to the support post that is substantially perpendicular (e.g., within +−5% of perpendicular to the ground, so between 85-95 degrees relative to a horizontal plane from the ground) to the ground. Examples of support posts include, but are not limited to, fence posts in a residential property (e.g., as shown in FIG. 4), fence posts surrounding farmland or pastures (e.g., as shown in FIG. 4), and can also include mailbox posts (e.g., as shown in FIG. 5), etc.).

In some embodiments, the insertion-assistance member is removably attached (606) to the elongated stake (e.g., as shown in FIGS. 2A-2B where the insertion-assistance member is removably attached to the elongated stake 100), wherein the insertion-assistance member includes: a body (e.g., a body that is at least partially hollow, such as body component 104 shown in FIG. 1B that includes a hollow portion 108, that is configured to fit over the top of the elongated stake (e.g., as shown in FIGS. 2A-2B)), and a lip (e.g., made of a solid material that is able to receive force from various types of hammers, such as lip component 102 shown in FIGS. 1A-1B) that extends in a direction that is substantially perpendicular (e.g., within +/−5% of perpendicular) to the body such that a portion of the lip extends beyond the body in the direction that is substantially perpendicular to the body, wherein the lip is configured to receive force and then transmit the force to the elongated stake to drive it into the ground. For example, FIGS. 3A-3B, show the insertion-assistance member 100 coupled to the elongated stake 200 and the elongated stake being driven into the ground 302. In some embodiments, the solid lip of the insertion-assistance member is a protrusion (e.g., flange) that aids in inserting the elongated stake into the ground, by providing a surface that allows force to be applied to insert the elongated stake into the surface. In some embodiments, the lip (e.g., protrusion, flange, etc.) is substantially circular in shape (e.g., to match the force applied by the surface of a hammer).

In some embodiments, after driving the elongated stake into the ground via the force received by the lip (e.g., as shown in FIG. 3B), the insertion-assistance member is removed from its removable attachment to the elongated stake (608). For instance, the insertion-assistance member is lifted off of the top of the elongated stake using a light force from a user's hand or hands alone and with needing any mechanical tools (as was discussed above).

In some embodiments, the elongated stake is secured (610) to the support post to provide sturdiness to the support post (e.g., as shown in FIG. 3C the elongated stake 200 is secured to support post 300). In embodiments in which the system is used to restore sturdiness to a failing support post, the system can be said to also restore structural integrity to the failing support post, in addition to also providing sturdiness to that failing support post (e.g., FIGS. 4 and 5 illustrate the elongated stake 200 providing sturdiness to failing support post 400 and failing mailbox post 500).

At step 612, the now-removed insertion-assistance member can be reused to assist with providing sturdiness to any number of different support posts.

It will be understood that, although the terms "first," "second," etc. may be used herein to describe various elements, these elements should not be limited by these terms. These terms are only used to distinguish one element from another.

The terminology used herein is for the purpose of describing particular embodiments only and is not intended to be limiting of the claims. As used in the description of the embodiments and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

The foregoing description, for purpose of explanation, has been described with reference to specific embodiments. However, the illustrative discussions above are not intended to be exhaustive or to limit the claims to the precise forms disclosed. Many modifications and variations are possible in view of the above teachings. The embodiments were chosen and described in order to best explain principles of operation and practical applications, to thereby enable others skilled in the art.

What is claimed is:

1. A system for providing sturdiness to multiple support posts of different shapes, comprising:

an elongated stake having a pointed end to be inserted into the ground such that the elongated stake is positioned parallel to a support post that is substantially perpendicular to the ground, wherein the elongated stake has a first shape;

an insertion-assistance member to be removably attached to the elongated stake, the insertion-assistance member including:

a hollow body to removably fit over an end of the elongated stake having the first shape, and a lip having a semi-circular shape and formed of a solid material, the lip extending in a direction that is substantially perpendicular to the hollow body such that a portion of the lip extends beyond the hollow body in the direction that is substantially perpendicular to the hollow body, wherein the lip is to receive force and then transmit the force to the elongated stake to drive the elongated stake into the ground, and further wherein, after driving the elongated stake into the ground via the force received by the lip, the insertion-assistance member is to be removed from the elongated stake and the elongated stake is to then be secured to the support post to provide sturdiness to the support post, and the insertion-assistance member is to be removably attached to a different elongated stake, having a second shape that is distinct from the first shape, by removably fitting the hollow body of the insertion-assistance member over an end of the different elongated stake having the second shape, such that the lip of the insertion-assistance member is used to receive additional force and transmit the additional force to the different elongated stake to drive the different elongated stake into the ground to thereby provide sturdiness to a different support post.

2. The system of claim 1, wherein the end of the elongated stake having the first shape, and over which the hollow body of the insertion-assistance member is removably fit, is a non-pointed end of the elongated stake.

3. The system of claim 1, wherein:

the elongated stake includes at least one hole passing therethrough, and the elongated stake is secured to the support post by inserting a fastener through the hole and into a portion of the support post.

4. The system of claim 1, wherein:

the elongated stake includes two holes passing therethrough, and the elongated stake is secured to the support post by inserting a respective fastener through each respective hole of the two holes into a respective portion of the support post.

5. The system of claim 3, wherein at least one of the fasteners is selected from a group consisting of a slidable pin, a nail, a screw, or a rivet.

6. The system of claim 3, wherein the fastener is removable.

7. The system of claim 1, wherein:

the insertion-assistance member is to, after removably attaching to the elongated stake for a second time, enable removal of the elongated stake from the ground by application of a removal force to the lip of the insertion-assistance member.

8. The system of claim 7, wherein:

the insertion-assistance member has at least one hole passing therethrough, and the removably attaching of the insertion-assistance member to the elongated stake for the second time is by way of a fastener that is placed through the at least one hole of the insertion-assistance member and through at least one hole of the elongated stake.

9. The system of claim 8, wherein:

the insertion-assistance member has at least two holes passing therethrough, and the removably attaching of the insertion-assistance member to the elongated stake for the second time is by way of two fasteners that are placed through the at least two holes of the insertion-assistance member and through at least two holes of the elongated stake.

10. The system of claim 8, wherein:

the elongated stake is secured to the support post to provide sturdiness by way of the fastener, and the fastener is to be removed from the elongated stake and the support post for use with the removably attaching of the insertion-assistance member to the elongated stake for the second time.

11. The system of claim 1, wherein a shape of the support post is cylindrical, rectangular, triangular, or polygonal.

12. The system of claim 1, wherein a shape of the elongated stake corresponds to the shape of the support post.

13. The system of claim 1, wherein a width of the insertion assistance-member is between 110% to 125% of a width of the elongated stake.

14. The system of claim 1, wherein the support post is not secured to the ground using a composite material, and is instead secured to the ground only by way of the elongated stake.

15. The system of claim 1, wherein a material of the elongated stake is the same as a material of the insertion-assistance member.

16. The system of claim 1, wherein the support post is a rotted or failing support post.

17. A method of providing sturdiness to multiple support posts of different shapes, the method comprising:

positioning an elongated stake having a pointed end to be inserted into the ground such that the elongated stake is positioned parallel to the support post that is substantially perpendicular to the ground, wherein the elongated stake has a first shape;

removably attaching an insertion-assistance member to the elongated stake, wherein the insertion-assistance member includes:

a hollow body to removably fit over an end of the elongated stake having the first shape, and a lip having a semi-circular shape and formed of a solid material, the lip extending in a direction that is substantially perpendicular to the body such that a portion of the lip extends beyond the hollow body in the direction that is substantially perpendicular to the hollow body, wherein the lip is to receive force and then transmit the force to the elongated stake to drive it into the ground;

after driving the elongated stake into the ground via the force received by the lip, removing the insertion-assistance member from the elongated stake;

securing the elongated stake to the support post to provide sturdiness to the support post; and removably attaching the insertion-assistance member to a different elongated stake, having a second shape that is distinct from the first shape, by removably fitting the hollow body of the insertion-assistance member over an end of the different elongated stake having the second shape, such that the lip of the insertion-assistance member is used to receive additional force and transmit the additional force to the different elongated stake to drive the different elongated stake into the ground to thereby provide sturdiness to a different support post.

18. An insertion-assistance member used in a system for providing sturdiness to multiple support posts of different shapes, comprising:

a hollow body to removably fit over an end of an elongated stake having a first shape, and a lip having a semi-circular shape and formed of a solid material, the lip extending in a direction that is substantially perpendicular to the hollow body such that a portion of the lip extends beyond the body in the direction that is substantially perpendicular to the hollow body, wherein:

the lip is to receive force and then transmit the force to the elongated stake to drive the elongated stake into the ground, and the elongated stake has a pointed end that is configured to be inserted into the ground such that the elongated stake is positioned parallel to the support post that is substantially perpendicular to the ground;

and further wherein, after driving the elongated stake into the ground via the force received by the lip, the insertion-assistance member is configured to be removed from the elongated stake and the elongated stake is to then be secured to the support post to provide sturdiness to the support post, and the insertion-assistance member is to be removably attached to a different elongated stake, having a second shape that is distinct from the first shape, by removably fitting the hollow body of the insertion-assistance member over an end of the different elongated stake having the second shape, such that the lip of the insertion-assistance member is used to receive additional force and transmit the additional force to the different elongated stake to drive the different elongated stake into the ground to thereby provide sturdiness to a different support post.

* * * * *